US007412799B1

(12) United States Patent
Aguirre

(10) Patent No.: US 7,412,799 B1
(45) Date of Patent: Aug. 19, 2008

(54) RELEASABLE SECURITY SHUTTER SYSTEM

(76) Inventor: Loida Aguirre, 23032 Ash Glen Cir., Valencia, CA (US) 91354

( * ) Notice: Subject to any disclaimer, the term of this patent is extended or adjusted under 35 U.S.C. 154(b) by 565 days.

(21) Appl. No.: 11/007,106

(22) Filed: Dec. 7, 2004

(51) Int. Cl.
*E06B 9/02* (2006.01)

(52) U.S. Cl. ..... 49/56; 49/87.1; 49/394; 49/51

(58) Field of Classification Search ..... 49/74.1, 49/87.1, 92.1, 394, 402, 50, 51, 56; 16/319, 16/324, 327, 326, 332, 348, 349
See application file for complete search history.

(56) References Cited

U.S. PATENT DOCUMENTS 547,327 A * 10/1895 Bunker ..... 16/326
3,448,486 A * 6/1969 Wright ..... 16/324
3,969,788 A * 7/1976 McCullough ..... 16/326
4,638,596 A * 1/1987 Gallardo ..... 49/56
4,688,351 A * 8/1987 Torres ..... 49/74.1
4,967,509 A * 11/1990 Storey et al. ..... 49/74.1
5,485,699 A * 1/1996 Gabhart ..... 49/394
5,490,353 A * 2/1996 McLaughlin ..... 49/64
5,619,821 A 4/1997 St. George et al.
5,622,395 A * 4/1997 Shine et al. ..... 292/125
7,017,234 B2 * 3/2006 Anderson ..... 16/332
2002/0000022 A1 * 1/2002 Schillaci et al. ..... 16/319
2003/0041521 A1 * 3/2003 Toth ..... 49/394

* cited by examiner

*Primary Examiner*—Gregory J. Strimbu

(57) ABSTRACT

A security shutter system for providing security against forced entry through a window. The security shutter system includes a securing frame being coupled to a wall of the structure around the window. A shutter frame is pivotally coupled to the securing frame and is selectively pivoted over the securing frame and secured to the securing frame over the window. The shutter frame is designed for inhibiting access into the structure through the window when the shutter frame is positioned over the window. A plurality of slat members are pivotally coupled to the shutter frame. Each of the slat members is selectively pivoted between a vertical orientation and a horizontal orientation. Each of the slat members controls light passage and visibility through the window.

10 Claims, 5 Drawing Sheets

RELEASABLE SECURITY SHUTTER SYSTEM

I. BACKGROUND OF THE INVENTION

The present invention relates to security window shutters and more particularly pertains to a new security shutter system for providing security against forced entry through a window.

II. DESCRIPTION OF THE PRIOR ART

The use of security window shutters is known in the prior art. U.S. Pat. No. 4,967,509 describes a system for providing high security grating that has the appearance of window shutters. Another type of security window shutter is U.S. Pat. No. 5,490,353 having a reinforced casing and shutters to prevent the unauthorized entrance of a person through the window. U.S. Pat. No. 5,619,821 has a security grill that has a foot actuator that allows for the shutter of the grill to be quickly pivoted to provide a shield against intrusion.

While these devices fulfill their respective, particular objectives and requirements, the need remains for a system that has certain improved features allowing for the protective bars to be easily moved out of the way to allow access to the window in case of an emergency.

III. SUMMARY OF THE INVENTION

The present invention meets the needs presented above by providing a lock assembly that secures the shutter frame to the securing frame when the shutter frame is positioned against the securing and allows the shutter frame to be pivoted away from the securing frame when the lock assembly is actuated by the user.

To this end, the present invention generally comprises a securing frame being designed for being coupled to a wall of the structure whereby the securing frame is positioned around the window. A shutter frame is pivotally coupled to the securing frame. The shutter frame is selectively pivoted over the securing frame and secured to the securing frame whereby the shutter frame is designed for being positioned over the window of the structure. The shutter frame is designed for inhibiting access into the structure through the window when the shutter frame is positioned over the window and secured to the securing frame. A plurality of slat members are pivotally coupled to the shutter frame. Each of the slat members is selectively pivoted between a vertical orientation and a horizontal orientation. Each of the slat members is designed for blocking a portion of light passing through the window and obstructing viewing through the window when the slat members are positioned in the vertical orientation. The slat members are designed for permitting a user to view through the window when the slat members are positioned in the horizontal orientation.

There has thus been outlined, rather broadly, the more important features of the security shutter system in order that the detailed description thereof that follows may be better understood, and in order that the present contribution to the art may be better appreciated. There are additional features of the security shutter system that will be described hereinafter and which will form the subject matter of the claims appended hereto.

In this respect, before explaining at least one embodiment of the security shutter system in detail, it is to be understood that the security shutter system is not limited in its application to the details of construction and to the arrangements of the components set forth in the following description or illustrated in the drawings. The security shutter system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present security shutter system. It is important, therefore, that the claims be regarded as including such equivalent constructions insofar as they do not depart from the spirit and scope of the present invention.

It is therefore an object of the present invention to provide a new security shutter system that provides security against unauthorized entry and is not visually obtrusive.

It is another object of the present invention to provide a new security shutter system that has an actuation assembly that can be used by anybody in the structure to actuate the lock assembly and allow the shutter frame to pivot with respect to the securing frame.

It is another object of the present invention to provide a security shutter system which has all of the advantages of the prior art and none of the disadvantages.

It is another object of the present invention to provide a security shutter system which may be easily and efficiently manufactured and marketed.

It is another object of the present invention to provide a security shutter system which is of durable and reliable construction.

It is yet another object of the present invention to provide a security shutter system which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
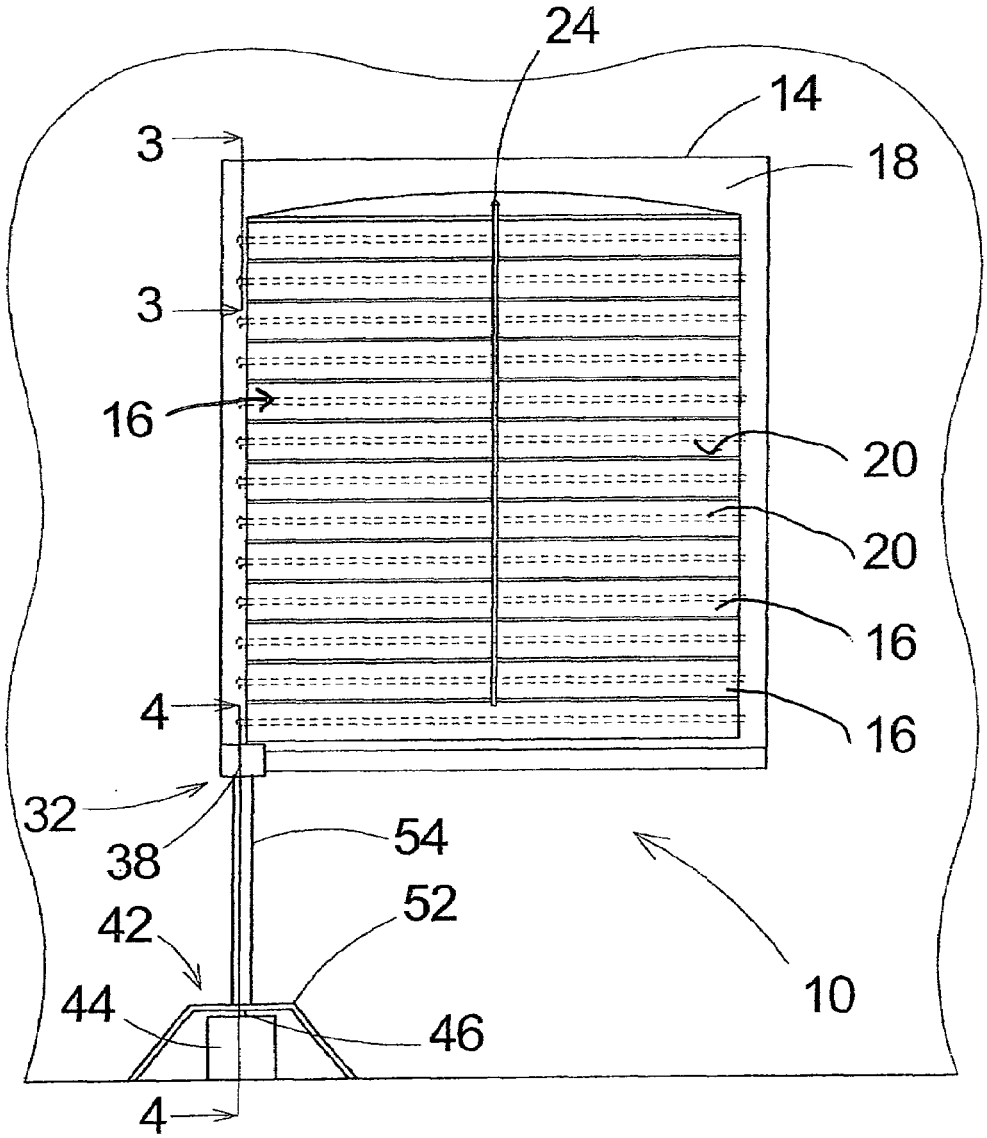
FIG. 1 is a front view of a new security shutter system according to the present invention with the shutter frame positioned against the securing frame.
Figure 2:
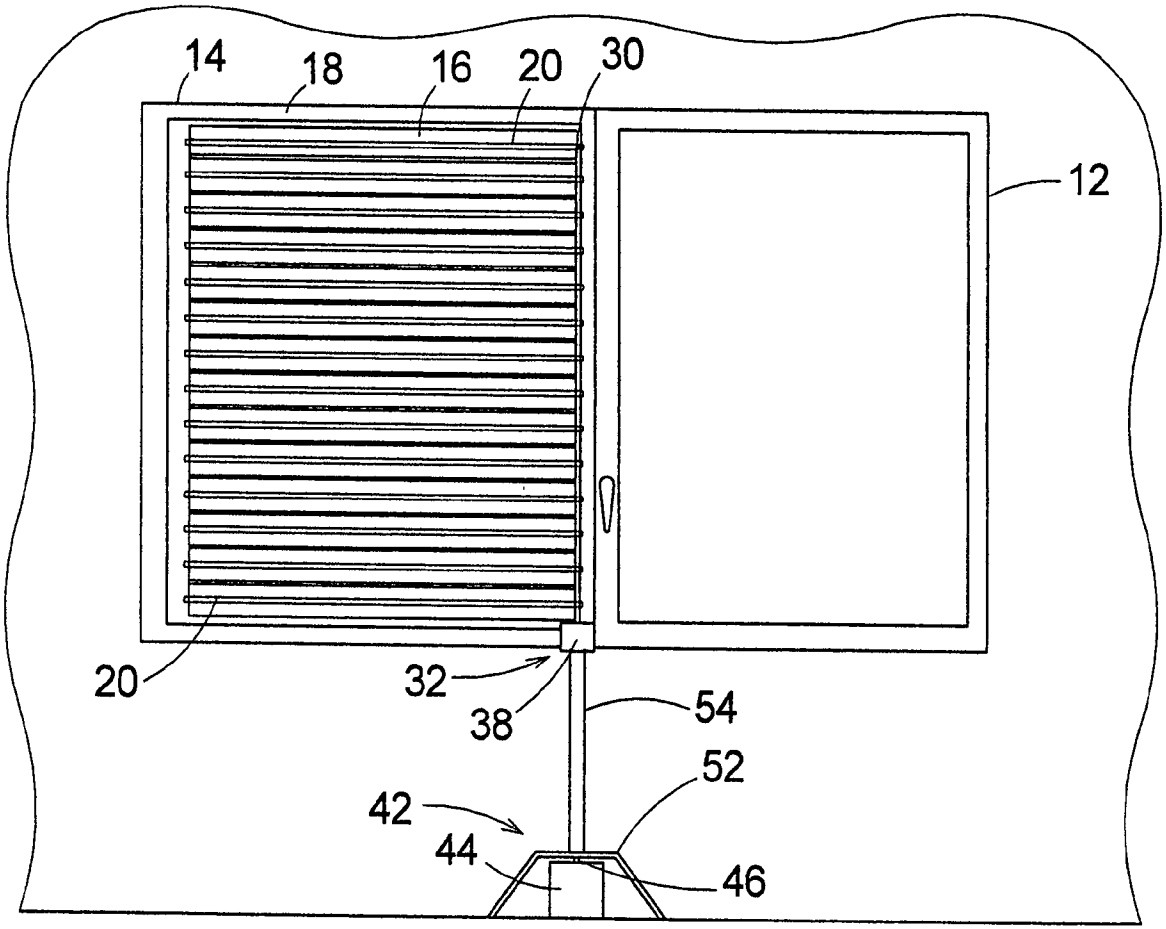
FIG. 2 is a front view of the present invention with the shutter frame pivoted away from the securing frame.
Figure 3:
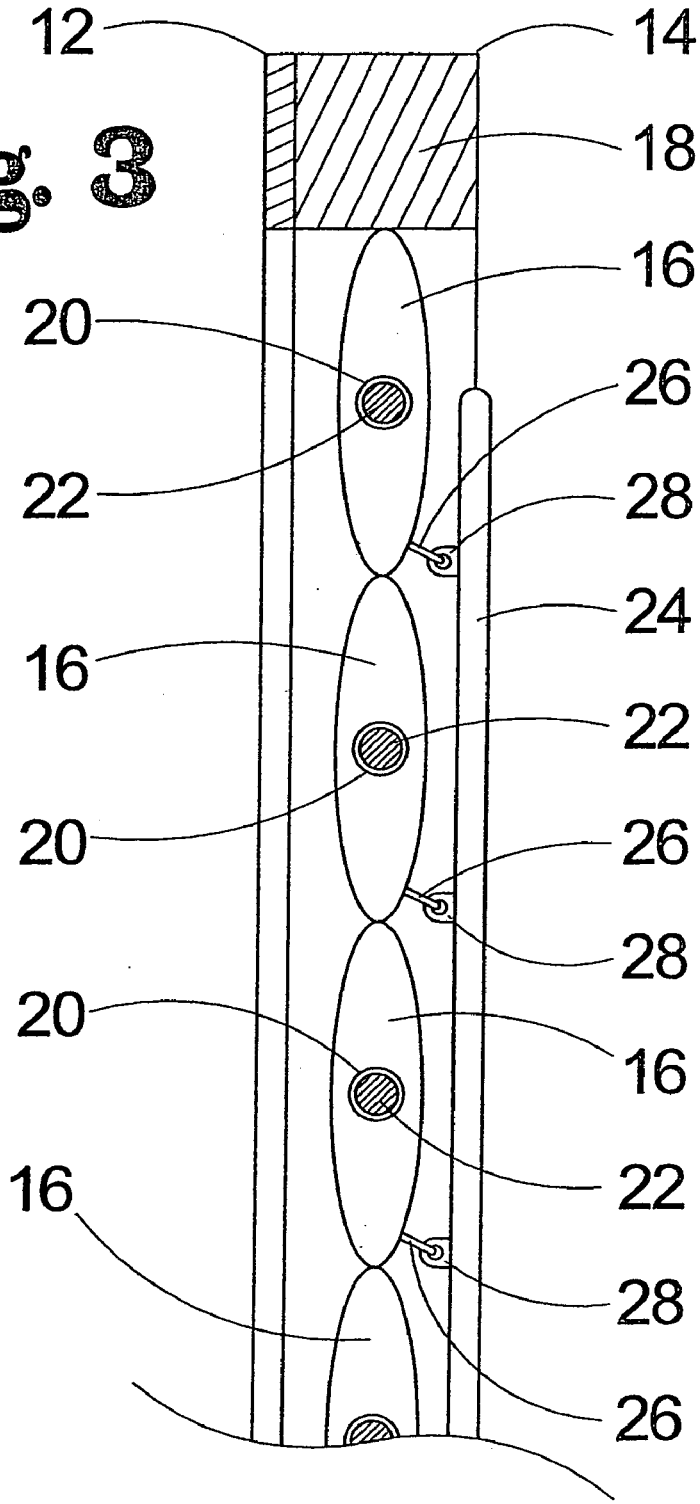
FIG. 3 is a cross-sectional view of the present invention taken along line 3-3 of FIG. 1.
Figure 4:
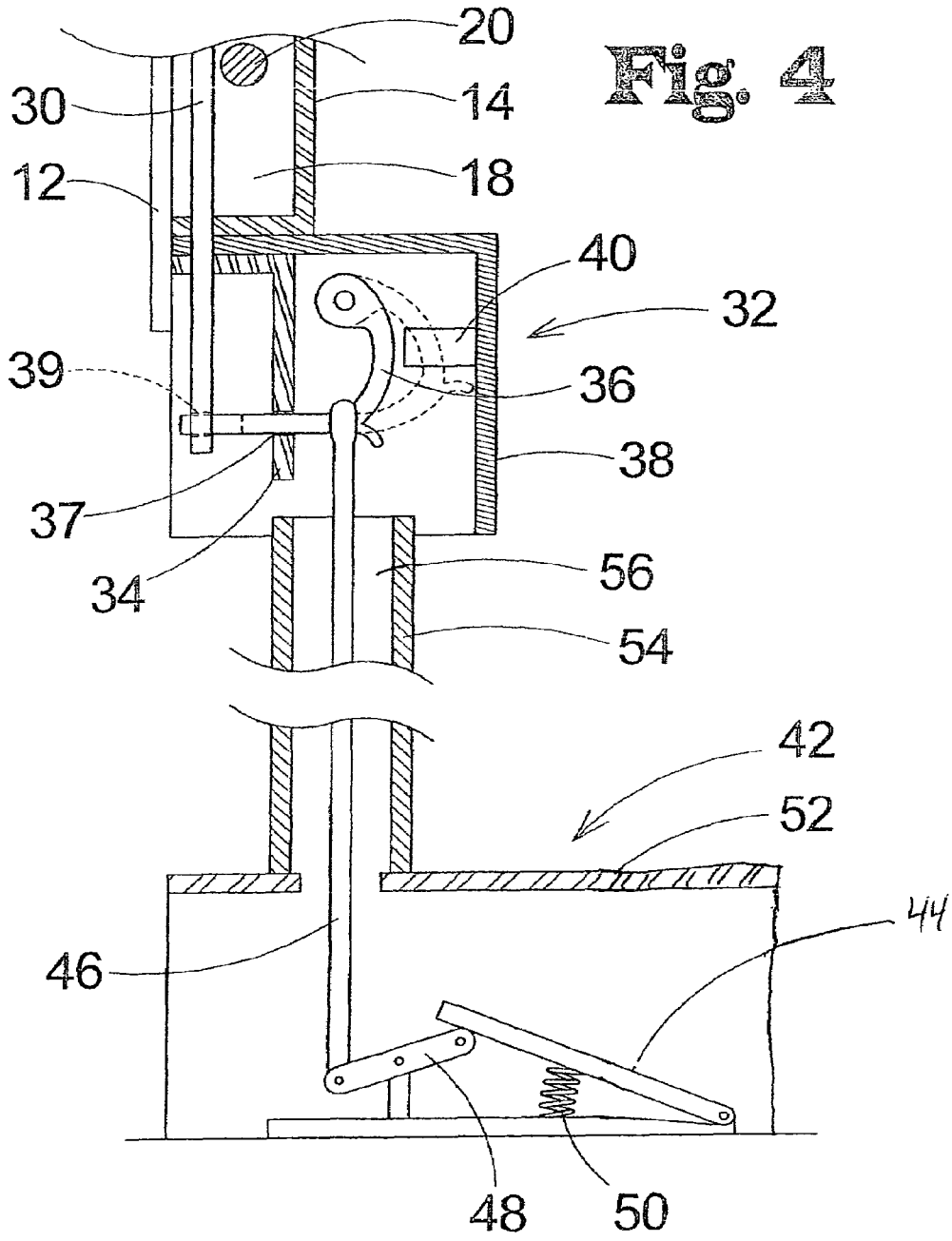
FIG. 4 is a cross-sectional view of the present invention taken along line 4-4 of FIG. 1.

With reference now to the drawings, and in particular to FIGS. 1 through 4 thereof, a new security shutter system embodying the principles and concepts of the present invention and generally designated by the reference numeral 10 will be described.

Figure 5:
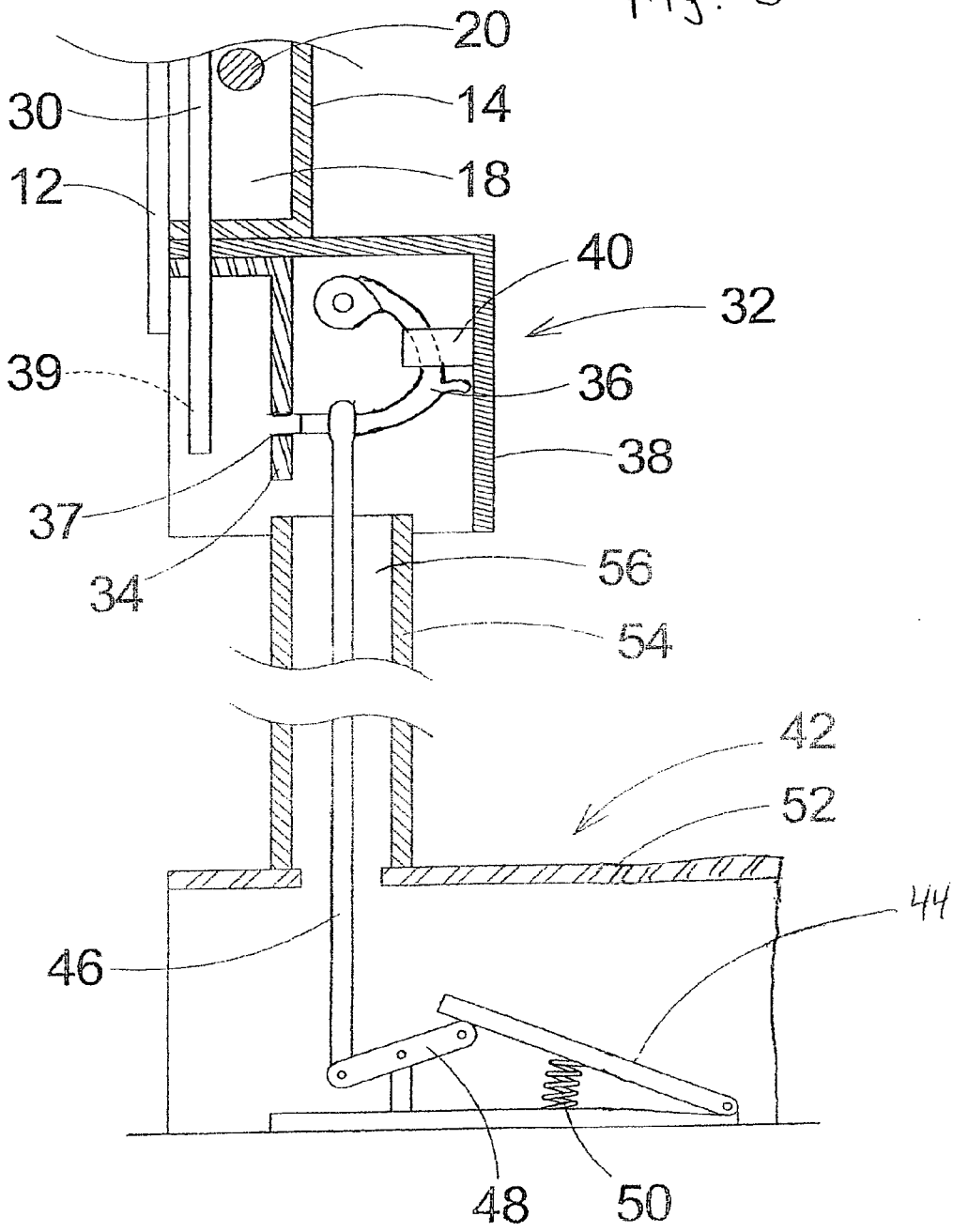
FIG. 5 is a cross-sectional view of the present invention taken along line 4-4 of FIG. 1, with locking member in the retracted position.

As best illustrated in FIGS. 1 through 6, the security shutter system 10 generally comprises a securing frame 12 being designed for being coupled to a wall of the structure whereby the securing frame 12 is positioned around the window.

A shutter frame 14 is pivotally coupled to the securing frame 12. The shutter frame 14 is selectively pivoted over the securing frame 12 and secured to the securing frame 12 whereby the shutter frame 14 is designed for being positioned over the window of the structure. The shutter frame 14 is designed for inhibiting access into the structure through the window when the shutter frame 14 is positioned over the window and secured to the securing frame 12.

A plurality of slat members 16 are pivotally coupled to the shutter frame 14. Each of the slat members 16 is selectively pivoted between a vertical orientation and a horizontal orientation. Each of the slat members 16 is designed for blocking a portion of light passing through the window and obstructing viewing through the window when the slat members 16 are positioned in the vertical orientation. The slat members 16 are designed for permitting a user to view through the window when the slat members 16 are positioned in the horizontal orientation.

The shutter frame 14 comprises a frame member 18 and a plurality of bar members 20. The frame member 18 is pivotally coupled to the securing frame 12 whereby the frame member 18 is selectively secured to the securing frame 12. The bar members 20 are coupled to the frame member 18. Each of the slat members 16 is pivotally coupled to one of the bar members 20 whereby each of the slat members 16 are selectively pivoted about the associated one of the bar members 20. The bar members 20 is designed for inhibiting entrance through the frame member 18 when the frame member 18 is coupled to the securing frame 12. The frame member 18 and the bar members 20 comprise a rigid material. The rigid material is for resisting deformation due to force applied to the frame member 18 and the bar members 20 whereby the rigid material is designed for resisting manipulation by an intruder trying to access the structure through the window.

Each of the slat members 16 comprises a pivot bore 22. The pivot bore 22 extends through the slat members 16. The pivot bore 22 of each of the slat members 16 receives one of the bar members 20 whereby each of the slat members 16 pivots around the associated one of the bar members 20 to allow each of the slat members 16 to be selectively pivoted between the vertical orientation and the horizontal orientation.

A control rod 24 is coupled to the slat members 16. The control rod 24 is selectively actuated for pivoting the slat members 16 between the horizontal orientation and the vertical orientation.

Each of the slat members 16 comprises a ring member 26 extending outwardly from the associated one of the slat members 16. A plurality of loop members 28 are coupled to the control rod 24. One of the loop members 28 extends between the ring member 26 of the associated one of the slat members 16 whereby the loop members 28 pull on the ring member 26 of each of the slat members 16 to pivot the slat members 16 when the control rod 24 is actuated.

A hinge rod 30 is coupled to the shutter frame 14. The securing frame 12 is hingably coupled to the hinge rod 30 whereby the shutter frame 14 is pivotal with respect to the securing frame 12.

A lock assembly 32 is coupled to the securing frame 12. The lock assembly 32 selectively engages the hinge rod 30 when the shutter frame 14 is positioned against the securing frame 12. The lock assembly 32 inhibiting pivoting of the shutter frame 14 with respect to the securing frame 12 when the shutter frame 14 is positioned against the securing frame 12. The lock assembly 32 is selectively actuated to disengage the hinge rod 30 to allow the shutter frame 14 to be pivoted with respect to the securing frame 12 when a user needs to exit the structure through the window.

The lock assembly 32 comprises an anchor member 34 and a lock member 36. The anchor member 34 is coupled to the securing frame 12. The lock member 36 is slidably coupled to the anchor member 34. The anchor member 34 comprises a lock aperture 37 extending through the anchor member 34. The lock aperture 37 of the anchor member 34 is aligned with a securing aperture 39 extending through the hinge rod 30 when the shutter frame 14 is positioned against the securing frame 12. The lock member 36 is selectively extended through the lock aperture 37 of the anchor member 34 and the securing aperture 39 of the of the hinge rod 30 to inhibit pivoting of the shutter frame 14 with respect to the securing frame 12.

The lock assembly 32 comprises a shield member 38. The shield member 38 is coupled to the securing frame 12 whereby the shield member 38 extends over the anchor member 34 and the lock member 36 to inhibit the lock member 36 being tampered with.

The lock assembly 32 comprises a clip member 40. The clip member 40 is coupled to the shield member 38 whereby the clip member 40 is aligned with the lock member 36. The clip member 40 selectively engages the lock member 36 to inhibit the lock member 36 from pivoting into the lock aperture 37 and the securing aperture 39 to allow the shutter frame 14 to pivot with respect to the securing frame 12 when the user wishes free movement of the shutter frame 14.

An actuation assembly 42 selectively engages the lock member 36 of the lock assembly 32. The actuation assembly 42 selectively slides the lock assembly 32 out of the securing aperture 39 of the hinge rod 30 and the lock aperture 37 of the anchor member 34 to permit the shutter frame 14 to be pivoted with respect to the securing frame 12 when the actuation assembly 42 is actuated by the user.

The actuation assembly 42 comprises a pedal member 44 and an actuation member 46. The actuation member 46 is operationally coupled to the pedal member 44. The actuation member 46 selectively engages the lock member 36 whereby the actuation member 46 pivots the lock member 36 out of the lock aperture 37 and the securing aperture 39 when the pedal member 44 is actuated by the user.

The actuation assembly 42 comprises a linkage member 48. The linkage member 48 is operationally coupled between the pedal member 44 and the actuation member 46 whereby the linkage member 48 pushes the actuation member 46 upwardly against the lock member 36 to pivot the lock member 36 out of the lock aperture 37 and the securing aperture 39 when the pedal member 44 is actuated by the user.

The actuation assembly 42 comprises a biasing member 50. The biasing member 50 is coupled to the pedal member 44 whereby the biasing member 50 biases the pedal member 44 into a raised positioned to disengage the actuation member 46 from the lock member 36 when the pedal member 44 is not being actuated by the user.

The actuation assembly 42 comprises a cover member 52. The cover member 52 is designed for being coupled to a support surface of the structure. The cover member 52 extends completely over the pedal member 44 whereby the cover member 52 is designed for inhibiting an object from being placed on the pedal member 44 and inadvertently actuating the pedal member 44 to inadvertently allow the shutter frame 14 to be pivoted with respect to the securing frame 12.

The actuation assembly 42 comprises a guide sleeve 54. The guide sleeve 54 is coupled to the cover member 52 whereby the guide sleeve 54 extends upwardly from the cover member 52. The actuation member 46 extending upwardly through the guide sleeve 54 whereby the guide sleeve 54 is for maintaining alignment of the actuation member 46 with the lock member 36 of the lock assembly 32 when the pedal member 44 is actuated by the user. The guide sleeve 54 has a guide aperture 56 extending through the guide sleeve 54. The guide aperture 56 receives the actuation member 46 whereby the actuation member 46 extends through the guide sleeve 54. The guide aperture 56 is adapted for permitting foreign objects placed in the guide aperture 56 of the guide sleeve 54 to pass through the guide aperture 56 of the guide sleeve 54 to inhibit the objects from hampering actuation of the actuation member 46.

In use, the user positions the shutter frame 14 against the securing frame 12. The lock member 36 is pivoted into the lock aperture 37 of the anchor member 34 and the securing aperture 39 of the hinge rod 30 to secure the shutter frame 14 from pivoting with respect to the securing frame 12. The control rod 24 is used to pivot the slat members 16 to control the amount of light allowed to enter the room and visibility through the window. The rod members and the shutter frame 14 provide added security in that the rod members and the shutter frame 14 inhibit forced entry into the structure by an intruder through the window. In case of an emergency where the user needs to exit the structure through the window the user can step on the pedal member 44 which actuates the actuation member 46 and slides the lock member 36 out of the lock aperture 37 and the securing aperture 39 to allow the shutter frame 14 to be pivoted with respect to the securing frame 12 and allow the user access to the window.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A security shutter system for selectively inhibiting access into a building through a window of the building, the security shutter system comprising:

a securing frame couplable to the building adjacent the window, a shutter frame being pivotally coupled to said securing frame, said shutter frame being selectively pivotable over said securing frame and secured to said securing frame such that said shutter frame is positionable over the window, said shutter frame inhibiting access into the building through the window when said shutter frame is positioned over the window and secured to said securing frame, a plurality of slat members being pivotally coupled to said shutter frame, each of said slat members being selectively pivotable between a vertical orientation and a horizontal orientation, each of said slat members being adapted to block a portion of light passing through the window and obstruct viewing through the window when said slat members are positioned in said vertical orientation, said shutter frame is pivoted over said securing frame, and said securing frame is coupled to the building, said slat members being adapted to permit a user to view through the window when said slat members are positioned in said horizontal orientation, a hinge rod coupled to said shutter frame, said securing frame being hingably coupled to said hinge rod such that said shutter frame is pivotal with respect to said securing frame, a lock assembly coupled to said securing frame, said lock assembly selectively engaging said hinge rod when said shutter frame is positioned against said securing frame to inhibit pivoting of said shutter frame with respect to said securing frame, when said lock assembly is engaging said hinge rod, said lock assembly is selectively actuatable to disengage said hinge rod to allow said shutter frame to be pivoted with respect to said securing frame when the user needs to exit the building through the window, wherein said lock assembly comprises an anchor member and a lock member, said anchor member being coupled to said securing frame, said lock member being pivotally coupled to said anchor member, said anchor member comprising a lock aperture extending through said anchor member, said lock aperture of said anchor member being aligned with a securing aperture extending through said hinge rod when said shutter frame is positioned against said securing frame such that said lock member is selectively extendable through said lock aperture of said anchor member and said securing aperture of said hinge rod to inhibit pivoting of said shutter frame with respect to said securing frame, an actuation assembly engaging said lock member of said lock assembly, when said shutter frame is positioned against said securing frame and said lock member is disposed in said lock aperture and said securing aperture, said actuation assembly selectively slides said lock member out of said securing aperture of said hinge rod and said lock aperture of said anchor member to permit said shutter frame to be pivoted with respect to said securing frame when said actuation assembly is actuated by the user, and wherein said actuation assembly comprises a pedal member and an actuation member, said actuation member being operationally coupled to said pedal member and said lock member such that said actuation member pivots said lock member out of said lock aperture and said securing aperture when said pedal member is actuated by the user.

2. The security shutter system as set forth in claim 1, wherein said shutter frame comprises a frame member and a plurality of bar members, said frame member being pivotally coupled to said securing frame, said bar members being coupled to said frame member, each of said slat members being pivotally coupled to a respective one of said bar members, said bar members being adapted for inhibiting entrance through said frame member.

3. The security shutter system as set forth in claim 2, wherein said frame member and said bar members are fabricated from a material, which resists deformation due to force applied to said frame member and said bar members such that said material is adapted for resisting manipulation by an intruder.

4. The security shutter system as set forth in claim 2, wherein each of said slat members has a pivot bore extending therethrough, said pivot bore of each of said slat members receiving said respective one of said bar members such that each of said slat members pivots around the respective one of said bar members to allow each of said slat members to be selectively pivoted between said vertical orientation and said horizontal orientation.

5. The security shutter system as set forth in claim 2, wherein each of said slat members comprises:

a ring member extending outwardly from said slat member, and a loop member being coupled to said ring member and a control rod such that said slat member pivots when said control rod is actuated.

6. The security shutter system as set forth in claim 1, further comprising a control rod coupled to said slat members, said control rod being selectively actuated for pivoting said slat members between said horizontal orientation and said vertical orientation.

7. The security shutter system as set forth in claim 1, wherein said actuation assembly further comprises a linkage member, said linkage member being operationally coupled between said pedal member and said actuation member such that said linkage member pushes said actuation member upwardly against said lock member to pivot said lock member out of said lock aperture and said securing aperture when said pedal member is actuated by the user.

8. The security shutter system as set forth in claim 1, wherein said actuation assembly further comprises a biasing member, said biasing member being coupled to said pedal member such that said biasing member biases said pedal member into a raised position.

9. The security shutter system as set forth in claim 1, wherein said actuation assembly further comprises a cover member, over said pedal member such that said cover member is adapted for inhibiting an object from being inadvertently placed on the pedal member and inadvertently actuating said pedal member.

10. The security shutter system as set forth in claim 9, wherein said actuation assembly further comprises a guide sleeve, said guide sleeve being coupled to said cover member such that said guide sleeve extends upwardly from said cover member, said actuation member extending upwardly through said guide sleeve such that said guide sleeve is for maintaining alignment of said actuation member with said lock member of said lock assembly when said pedal member is actuated by the user.

* * * * *